United States Patent [19]

Sorenson

[11] Patent Number: 4,473,870

[45] Date of Patent: Sep. 25, 1984

[54] LAMP HOUSING

[75] Inventor: Richard W. Sorenson, Avon, Conn.

[73] Assignee: Carlingswitch, Inc., West Hartford, Conn.

[21] Appl. No.: 499,436

[22] Filed: May 31, 1983

Related U.S. Application Data

[63] Continuation-in-part of Ser. No. 485,339, Apr. 15, 1983, abandoned.

[51] Int. Cl.[3] ..... H01R 33/00

[52] U.S. Cl. ..... 362/226; 362/311; 362/375; 340/815.14; 340/815.2; 200/310

[58] Field of Search ..... 200/310, 311, 315, 317; 340/815.12, 815.17, 815.14, 815.15, 815.2; 362/95, 253, 257, 311, 362, 375, 802

[56] References Cited

U.S. PATENT DOCUMENTS

| | | | |
|---|---|---|---|
| 2,786,196 | 3/1957 | Haynes et al. | 340/815.12 |
| 3,348,221 | 10/1967 | Duffield | 362/95 |
| 3,761,920 | 9/1973 | Houdbolt et al. | 340/815.14 |
| 3,808,581 | 4/1974 | Murray | 340/815.14 |
| 3,849,641 | 11/1974 | Plana | 340/815.14 |
| 4,037,908 | 7/1977 | Gallone | 340/815.12 |
| 4,095,067 | 6/1978 | La Scola | 200/310 X |
| 4,101,749 | 7/1978 | Josemans et al. | 200/317 |
| 4,172,973 | 10/1979 | Sano | 200/315 |
| 4,347,417 | 8/1982 | Sorenson | 200/315 X |

FOREIGN PATENT DOCUMENTS

| | | | |
|---|---|---|---|
| 2366737 | 6/1975 | Fed. Rep. of Germany | 200/315 |
| 2655478 | 6/1978 | Fed. Rep. of Germany | 200/315 |
| 1269091 | 3/1972 | United Kingdom | 248/27.3 |

*Primary Examiner*—Stephen Marcus
*Assistant Examiner*—Ernest G. Cusick
*Attorney, Agent, or Firm*—McCormick, Paulding & Huber

[57] ABSTRACT

A switch case has a lens member pivotally mounted in it so that a lamp resistor circuit provided in the lens member are connected to one another without solder, and so that the circuit components themselves prevent movement of the lens member in its pivotable mount.

6 Claims, 4 Drawing Figures

LAMP HOUSING

CROSS REFERENCE TO RELATED APPLICATIONS

This application is a continuation-in-part of Ser. No. 485,339 filed Apr. 15, 1983 now abandoned and is related to a co-pending application Ser. No. 423,219 filed Sept. 24, 1982 as continuation-in-part of Ser. No. 328,828 entitled SWITCH CONSTRUCTION filed Dec. 9, 1981 now issued under U.S. Pat. No. 4,389,552 as division Ser. No. 234,664 (now issued under U.S. Pat. No. 4,347,417). These SWITCH CONSTRUCTION applications are incorporated by reference herein.

SUMMARY OF INVENTION

This invention relates generally to electrically energizeable lamp housings, and deals more particularly with a housing which has a conventional electric switch case comprising a major part of the housing itself, and which has a lens member so constructed and arranged as to replace a conventional rocker actuator in a typical switch of generally rectangular configuration.

The general purpose of the present invention is to provide a unique lamp housing which utilizes a conventional electric switch case, and which has a lens snap fit in the upper portion of the case, preferably being held in place by the same interlocking geometry as normally provided between a conventional switch case and its rocker/actuator. More particularly, the present invention also seeks to provide for mounting a lamp in such a lens member together with its associated lamp lead wires and an associated resistor so that no soldering of the lamp wires is required at assembly of these components in the lamp housing.

A lamp housing of the present invention provides for conventional contact terminals to be utilized in the bottom wall of the switch case for illuminating a lamp held in a lens member which is snap fit inside the upwardly open cavity of a conventional plastic switch case. Aligned openings in the side walls of the switch case receive projecting portions of the lens member in much the same manner as a rocker/actuator in a conventional switch case. The lens member is of generally rectangular shape with a flat upper surface adapted to be mounted in flush relationship with that of the flanged bezel portion of the switch case. A resistor circuit includes a lamp and lamp lead wires and it is an important feature of the present invention that the resistor in the resistor circuit is provided directly between one of these lamp lead wires and one of the switch contact terminals. In one version the other lamp lead wire engages the upper end of a coiled compression spring acting between it and the other switch contact terminal so as to hold the lens member in a flush relationship to the switch case bezel as described above and to also urge the resistor in a contact with is associated switch contact terminal as described above. In a second version the other of the two lamp lead wires engages the upper end of the other switch contact. Both contacts have resilient inner, or upper ends, and serve to hold the resistor and the lamp lead wires securely in place without solder or other connecting means.

DETAILED DESCRIPTION OF FIGS. 1 AND 2

Figure 1:
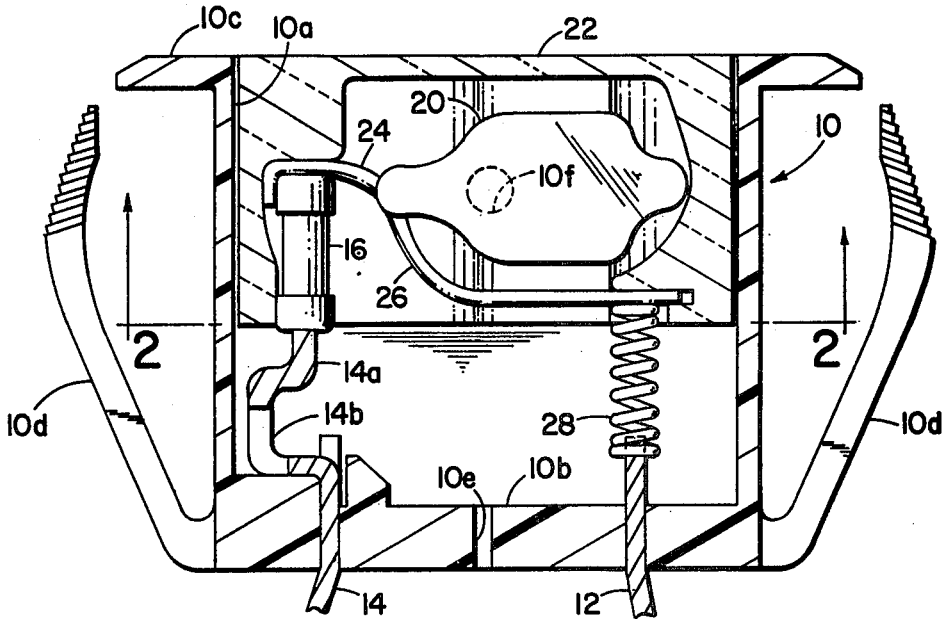
FIG. 1 is a vertical sectional view through a lamp housing constructed in accordance with the present invention.
Figure 2:
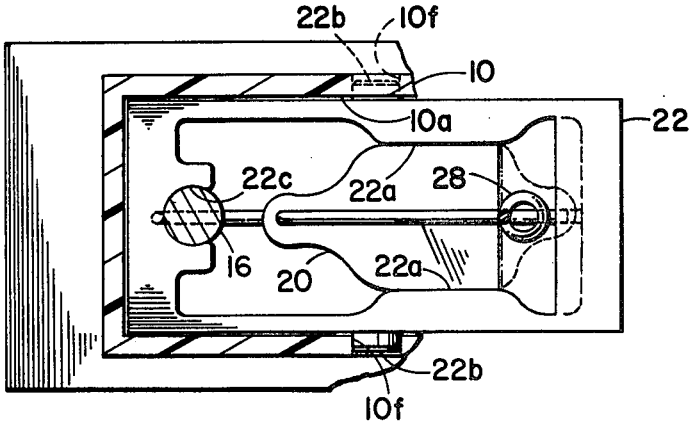
FIG. 2 is a sectional view taken generally on the line 2—2 of FIG. 1 but with portions of the switch case broken away to better reveal the construction of the lens member fitted into the upper end of the switch case.

Turning now to the drawings in greater detail, FIGS. 1 and 2 show a switch case 10 of one piece molded plastic configuration and having an upwardly open cavity 10*a* which cavity 10*a* is of generally rectangular configuration being more particularly defined by side and end walls of the switch case and by a bottom wall 10*b* integrally connected to these side and end walls. The case 10 has a peripherially extending flanged bezel 10*c* extending around the generally rectangular open cavity 10*a* and adapted to engage the face of a panel (not shown) in which the case 10 is adapted to be mounted by means of resilient wings 10*d* all in accordance with conventional switch case technology generally.

The bottom wall 10*b* is provided with at least two and preferably three slots such as shown at 10*e* in FIG. 1, and contact terminals 12 and 14 are provided in the endmost slots in accordance with conventional switch technology generally. Thus, the switch case 10 of FIGS. 1 and 2 can be utilized for receiving conventional switch components in order to provide a switch construction along the lines of that suggested in the above mentioned pending application and issued patent. These prior disclosures are incorporated by reference herein, especially that portion of said applications dealing with the use of a coiled compression spring between an electrical resistor and a lamp lead wire and an electrical switch.

The fixed contact 14 has an upper end portion 14*a* adapted to contact one end of an electrical resistor 16 so as to provide a series connection between the terminal 14 and a lamp 20 provided in lens member 22 to be described. The contact 14 has an intermediate generally C-shaped portion 14*b* which may be open so as to receive a movable contact element (not shown) of the type commonly used in such switches wherein an internal lamp is to be illuminated in conjunction with the operation of the switch as shown in greater detail in my pending patent application Ser. No. 423,219, filed Sept. 24, 1982 which application is also incorporated by reference herein. For present purposes the terminal 14 can be of any convenient shape but the shape shown is preferred in order to permit use of the switch case 10 either as a lamp housing in the manner described in this application or for use as a contact terminal in a conventional electrical switch as shown and described in my above mentioned co-pending applications.

Turning now to a more detailed description of the lens member 22 referred to previously, said member 22 has a generally rectangular configuration so as to be snugly received in the upper end of rectangular cavity 10*a* in the switch case 10. This member 22 is supported by aligned openings 10*f*, 10*f* provided for this purpose in generally centered relationship in the switch case side walls. Such openings 10*f*, 10*f* are provided for pivotally receiving a conventional switch actuator of the type inserted into the rectangular opening upon assembly when the switch case 10 is to be used as a conventional electrical switch. The plastic lens member 22 is preferably formed in one piece, but will of course be of transparent plastic material and may be of suitable color such as red, yellow or clear plastic in order that the light from lamp 20 can be seen from outside the lamp housing when the switch case 10 is inserted in a panel as described above, and when a circuit is closed to connect terminals 12 and 14 to a source of power.

The transparent plastic lens member 22 has a recess defined therein, and this recess is adapted to snugly receive a lamp such as that shown at 20 by reason of spaced lands 22*a* and 22*a* on opposed side walls of the lens member 22. This lens member 22 also includes laterally outwardly projecting portions 22*b*, 22*b* which projecting portions are adapted to be received in the aligned openings 10*f*, 10*f* in the switch case side walls. Still with reference to the lens member 22 the lamp cavity is more particularly defined by opposed side and end walls of the member 22 which side and end walls are shown in some detail in FIG. 2. One end wall, as shown the left hand end wall in FIG. 2, defines a socket 22*c* for snugly receiving the electrical resistor 16 in such a manner that a lamp lead wire 24 is adapted to be trapped between the upper end of resistor 16 and the inner end of the socket 22*c* as best shown in FIG. 1. As so constructed and arranged the resistor 16 is securely held in its socket 22*c* defined for this purpose in the lens member 22, and so to the lamp lead wire 24 is electrically connected to one end of the resistor so that the opposite end of the resistor can contact the fixed upper end of terminal 14 as shown at 14*a* in FIG. 1. It will be that the lens member 22 is mounted on opposed pivot points in the switch case 10 allowing the lens member 22 to oscillate however slightly within the switch case cavity 10*a*. In order to restrain this movement a coil compression spring 28 is provided between the upper end of terminal 12 and a second lamp lead wire 26 so that lens member 22 is held in a position such that the upper surface of lens member 22 remains flush with the flanged bezel suface 10*c* of the switch case. This geometry provides a pleasing configuration for the resulting lamp housing when mounted in a panel as described previously.

As so constructed and arranged the lamp housing of the present invention is well adapted to the assembly from a conventional switch case and a particularly designed lens defining member so as to retain a lamp therein and also retain its associated lamp leads and a resistor so that a large portion of a resistor for the lamp can be contained and retained within the lens member itself. Since the terminals of the switch case serve as further portions of the resistor circuit to illuminate the lamp it will be apparent that the lens and its components can be conveniently assembled with a switch case and its terminals by adding a spring between one of the lamp lead wires and the terminals in the switch case in order to easily fabricate a relatively inexpensive lamp housing.

DETAILED DESCRIPTION OF FIGS. 3 AND 4

Figure 3:
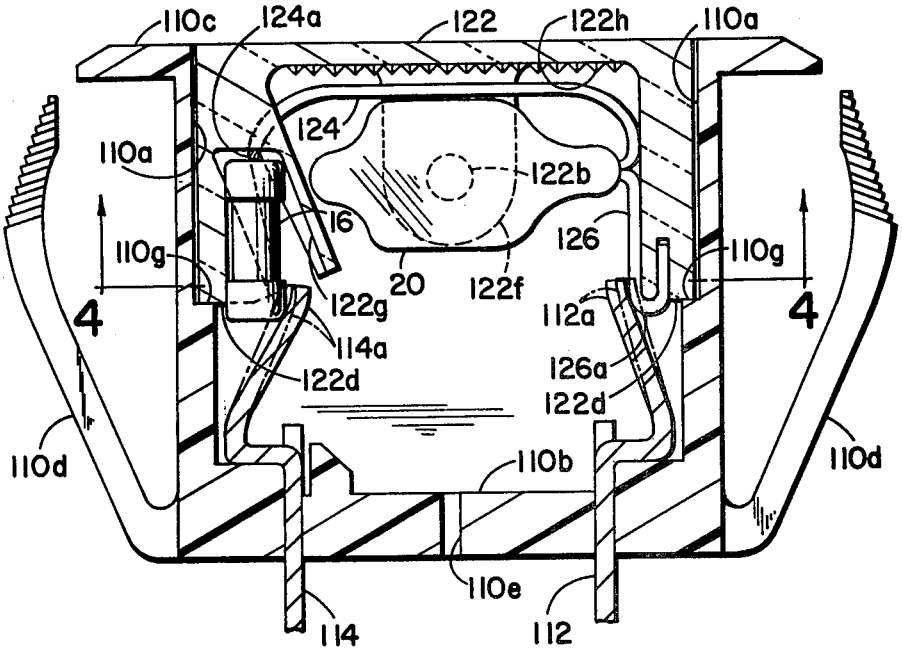
FIG. 3 is a vertical sectional view through a lamp housing constructed in accordance with an alternative version of the present invention.
Figure 4:
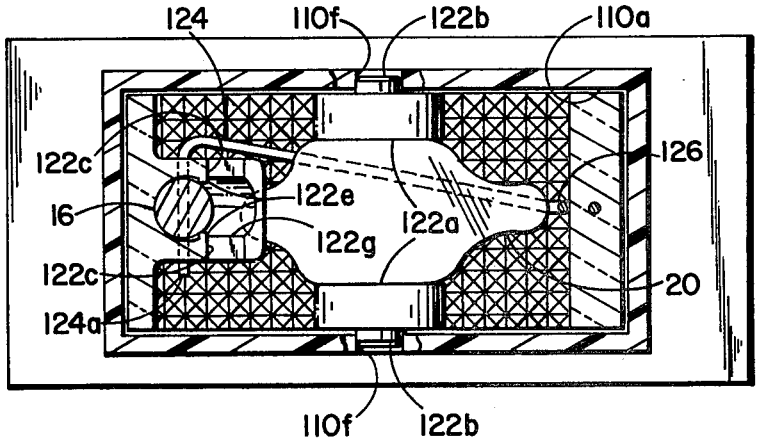
FIG. 4 is a sectional view taken generally on the line 4—4 of FIG. 3.

In FIGS. 3 and 4 the switch case 110, like that of the previous embodiment shown in FIGS. 1 and 2, is designed to be used as a housing having fixed contacts 112 and 114 in openings 110*e* of a bottom wall 110*b*. The case 110 has a cavity 110*a* surrounded by flanged bezel 110*c* and wings 110*d*, 110*d* designed to mount the case in a panel opening (not shown).

The fixed contacts 112 and 114 may be identical to one another in this FIG. 3 version, unlike the contacts 12 and 14 of FIG. 1, and each said contact has an upper portion 112*a* (and 114*a*) so formed as to be resiliently deformable laterally by the insertion of a lens member 122. See FIG. 3 and compare the broken line and solid line positions for these contact portions 112*a* and 114*a*.

Turning next to a more detailed description of the lens member 122, like member 22 of FIG. 1 and FIG. 2 this member 122 is fabricated from a light transmitting plastic, preferably of some convenient color such as red, green, or other identifying hue, and has a shape such that it is snugly received in the case cavity 110*a* and such that laterally projecting portions 122*b*, 122*b* snap into aligned openings 110*f*, 110*f* in the case side walls. Thus, the lens 122 is pivotably mounted in the switch case 110, except that any substantial pivotal movement is limited in the FIG. 3 configuration by reason of shelf 110*g* of case 110 engaging the lower end of leg 122*d* of lens 122. In order to prevent any possible movement, however slight, of lens 122 with respect to the case 110 and in order to avoid the use of a compression spring such as that shown in the FIG. 1 version, I have designed the FIG. 3 version to derive the necessary biasing force for holding lens 122 in place from the resilient contact portions 112*a* and 114*a*.

Still with reference to the lens 122 of FIG. 3 a lamp 20 is held in a recess of the lens and more particularly the lamp 20 is adapted to be snugly received between spaced lands 122*a*, 122*a* just as in the earlier embodiment. The lamp 20 has lead wires 124 and 126 adapted to be connected to a resistor 16 and to contact 112 respectively.

The resistor 16 is a conventional element, as is the lamp 20 with its lead wires 124 and 126. Together, these conventional elements comprise a lamp-resistor circuit. The contacts 112 and 114 are in series with these elements and can be connected to a source of electrical energy to illuminate lens 122.

Resistor 16 is retained in a uniquely configured recess 122*f* (as best shown in FIG. 4). The resistor 16 is installed by inserting it along the guide surface 122*d* so as to trap the end portion 124*a* of lamp lead 124 in the V-shaped slots 122*c*, 122*c* provided for it on both sides of this recess 122*f*.

The guide surface 122*g* includes portions 122*e*, 122*e* of reduced cross section, which portions are defined by depending walls of the lens member 122, and as so constructed and arranged the installation of resistor 16 can be very easily achieved simply by inserting it along the axis of guide surface 122*d*, and then pressing the lower end of the resistor into its recess 122*f* (as shown in FIGS. 3 and 4) by forcing it past these integrally defined wall portions 122*e*, 122*e*.

The other lamp lead wire 126 has its end portion 126*a* bent in a U-shape so that one leg of the U fits into an opening provided for it in the leg 122*d* of the lens, and the other leg of the U-shaped end portion 126*a* is adapted to back up this wire end portion and assure that it engages the upper end 112*a* of contact 112 for transmitting electrical energy to the lamp.

Lens member 122 has a flat top surface, preferably planar and aligned with the top of the flanged bezel 110*c* of case 110. The inner surface 122*h* of the lens 122 is parallel to the top but is preferably ribbed or striated to improve its light scattering characteristics in the manner of a fresnel lens. Thus, light from lamp 20 will illuminate the entire top surface of lens member 122 when a source of electrical energy is impressed upon the exposed blade contacts 112 and 114.

Lens 122 has the same generally rectangular configuration as that of the upwardly open switch cavity 110*a*, and longitudinally extending marginal edge portions thereof are provided with depending central portions 122*f* that define the outwardly projecting pivot parts 122*b*, 122*b* referred to previously and the lands 122*a*, 122*a* for supporting and/or locating the lamp 20. End portions 122*d*, 122*d* of lens 122 serve to locate the lens in the case cavity 110*a* and define portions to support the resistor 16 and wires 124 and 126.

The assembly of the various components in the lamp housing of FIGS. 3 and 4 can be accomplished as follows. The case 110 is fitted with the contacts 112 and 114. Note that the upper ends 112*a* and 114*a* will be in the broken line position at this stage of assembly. The resistor and lamp are inserted in the appropriate portions of the lens 122, and the wires 124 and 126 inserted in place, all as described above. The lens is then pushed into the case cavity 110*a* so that projections 122*b*, 122*b* snap into the aligned openings 110*f*, 110*f* in the case side walls, and so that resistor 16 biases contact 114 from the broken to the solid line position shown at 114*a*. U-shaped wire portion 126*a* acts in a similar manner on the upper portion 112*a* of the other contact 112, biasing it from the broken to the solid line position as suggested in FIG. 4.

I claim:

1. A lamp housing comprising a case of insulating plastic having a generally rectangular upwardly open cavity and a flanged bezel surrounding said cavity, said case having side and end walls integrally connected to a bottom wall, said bottom wall having slots, at least two contact terminals in said slots, said side walls defining aligned openings, a transparent lens member having side walls with projecting portions received in and supported by said aligned openings, said member having a generally rectangular shape and being located in said case cavity so that its generally flat outer surface is flush with that of said flanged bezel, said member having end walls, one of which end walls has inwardly projecting spaced portions defining a resistor recess, said member also having portions defining a lamp recess, a lamp in said lamp recess of said lens member, a resistor circuit including lamp lead wires associated wth said lamp and including a coiled compression spring one end of which spring engages one of said terminals and the other end of which spring engages a lamp lead wire of said resistor circuit, a resistor in said resistor circuit, said resistor located in said resistor recess defined by said member and so oriented that one end of said resistor engages the other of said terminals and the other end of said resistor engages another lamp lead wire in said resistor recess so that said member is held in biased relation by said spring whereby said resistor circuit is closed when said terminals have a voltage impressed thereon to light said lamp through said resistor, and said resistor is urged into abutting relation to the other of said terminals by said spring.

2. The lamp housing of claim 1 wherein said transparent plastic member has an inner surface spaced from said lamp and parallel said flat outer surface, said inner surface being striated to provide a scattering effect for the light so emitted.

3. A lamp housing comprising a case of insulating plastic having a generally rectangular upwardly open cavity and a flanged bezel surrounding said cavity, said case having side and end walls integrally connected to a bottom wall, said bottom wall having slots defined therein, contact terminals received in said slots, said case side walls defining aligned openings, a lens member supported by said aligned openings and located in said case cavity so that its generally flat outer surface is flush with that of said flanged bezel, said lens member having end walls, a lamp retained in said member, a resistor with condutive end portions and retained in a recess defined in one end wall of said lens member, lamp lead wires one of which engages one end portion of said resistor and another lamp lead wire retained by the other end wall of said lens member, said terminals having resilient portions projecting upwardly from said bottom wall, said resistor being so located in said lens member that it engages one said resilient terminal portion, said another lamp lead wire having an end portion adapted to engage said resilient upwardly projecting portion of said other terminal whereby at least one of said terminals is deformed at least slightly and said lens member is secured in said case by such resilient deformation and said lamp is lit as a result of impressing a voltage across said terminals.

4. The lamp housing of claim 3 wherein said resilient upwardly projecting portions of said terminals comprise offset end portions integrally connected to intermediate C-shaped portions respectively, said terminal portions formed from an initially flat strip of metal which is so bent as to define said offset and C-shaped portions.

5. The lamp housing of claim 4 wherein said transparent plastic lens member has depending side walls defining aligned projections received in said aligned side wall case openings, and one of said member end walls defining inwardly projecting spaced portions defining said resistor recess.

6. The lamp housing of claim 3 wherein said transparent plastic lens member has depending side walls defining aligned projections received in said aligned side wall case openings, and one of said member end walls defining inwardly projecting spaced portions defining said resistor recess.

* * * * *